US008993948B2

(12) United States Patent
Geswender et al.

(10) Patent No.: US 8,993,948 B2
(45) Date of Patent: Mar. 31, 2015

(54) ROLLING VEHICLE HAVING COLLAR WITH PASSIVELY CONTROLLED AILERONS

(75) Inventors: Chris E. Geswender, Green Valley, AZ (US); Paul Vesty, Tucson, AZ (US); Geoffrey W. Frost, Tucson, AZ (US); Bruce E. Morgan, Tucson, AZ (US); Doron Strassman, Vail, AZ (US)

(73) Assignee: Raytheon Company, Waltham, MA (US)

( * ) Notice: Subject to any disclaimer, the term of this patent is extended or adjusted under 35 U.S.C. 154(b) by 822 days.

(21) Appl. No.: 13/215,497

(22) Filed: Aug. 23, 2011

(65) Prior Publication Data

US 2014/0312162 A1 Oct. 23, 2014

(51) Int. Cl.
*F42B 15/01* (2006.01)
*F42B 10/64* (2006.01)

(52) U.S. Cl.
CPC ..... *F42B 10/64* (2013.01); *F42B 15/01* (2013.01)
USPC ..... 244/3.24; 244/3.21; 102/501

(58) Field of Classification Search
USPC ..... 244/3.24, 3.21; 102/501, 517
See application file for complete search history.

(56) References Cited

U.S. PATENT DOCUMENTS

| | | | | |
|---|---|---|---|---|
| 3,007,258 | A * | 11/1961 | Hemstreet et al. | 434/45 |
| 3,603,532 | A * | 9/1971 | Harms | 244/3.21 |
| 3,690,596 | A * | 9/1972 | Durran et al. | 244/3.21 |
| 3,843,075 | A * | 10/1974 | Weber et al. | 244/3.15 |
| 4,512,537 | A * | 4/1985 | Sebestyen et al. | 244/3.21 |
| 5,425,514 | A | 6/1995 | Grosso | |
| 5,505,408 | A * | 4/1996 | Speicher et al. | 244/52 |
| 6,135,387 | A | 10/2000 | Seidel et al. | |
| 7,354,017 | B2 * | 4/2008 | Morris et al. | 244/3.23 |
| 7,412,930 | B2 | 8/2008 | Smith et al. | |
| 7,642,491 | B2 * | 1/2010 | Kusic | 244/3.22 |
| 7,825,359 | B2 * | 11/2010 | Kusic | 244/3.22 |
| 7,902,489 | B2 * | 3/2011 | Sirimarco et al. | 244/3.21 |
| 2005/0056723 | A1 * | 3/2005 | Clancy et al. | 244/3.24 |

(Continued)

FOREIGN PATENT DOCUMENTS

| | | | |
|---|---|---|---|
| ES | 21541047 | A1 | 3/2001 |
| GB | 582206 | A | 11/1946 |
| WO | 2006028485 | A1 | 3/2006 |

OTHER PUBLICATIONS

International Search Report and Written Opinion from corresponding International Application No. PCT/US12/47833.

*Primary Examiner* — Tien Dinh
*Assistant Examiner* — Michael Wang
(74) *Attorney, Agent, or Firm* — Renner, Otto, Boisselle & Sklar, LLP

(57) ABSTRACT

A spinning, rolling, or roll-stabilized vehicle, such as a projectile, includes a fuselage that rotates about its longitudinal axis (spins) during flight. A collar is positionable relative to the fuselage to steer the projectile, with the collar having ailerons to provide a roll force to position the collar. The collar also has elevators to provide lateral force to steer the projectile. The positioning of the collar may be accomplished by moderating the roll force of the ailerons to hold the position of the collar substantially constant with regard to a longitudinal axis of the projectile. The ailerons passively change angle of attack with changes in the dynamic pressure of the projectile. At low speeds the ailerons have a relatively large angle of attack, and at high speeds, the ailerons resiliently reduce their angles of attack, avoiding large rolling forces on the collar.

18 Claims, 5 Drawing Sheets

(56) References Cited

U.S. PATENT DOCUMENTS

2007/0007383 A1* 1/2007 Hsu et al. ..... 244/3.24
2008/0315032 A1 12/2008 Harnoy
2009/0218437 A1* 9/2009 Sirimarco et al. ..... 244/3.21
2010/0296258 A1 11/2010 Geswender
2012/0175458 A1* 7/2012 Geswender ..... 244/3.24
2012/0211593 A1* 8/2012 Morris et al. ..... 244/3.21

* cited by examiner

ROLLING VEHICLE HAVING COLLAR WITH PASSIVELY CONTROLLED AILERONS

BACKGROUND OF THE INVENTION

1. Field of the Invention

The invention is in the field of control systems for spinning, rolling, or roll stabilized vehicles, such as spinning or rolling projectiles/missiles.

2. Description of the Related Art

In certain military applications, there is a significant need for "smart" projectiles wherein the operator can effectively control the course the projectile takes and the target location that is impacted. Such navigational control requires the ability to impart precise forces to a rapidly spinning projectile with respect to the Earth inertial frame to achieve a desired directional course. Some past devices have used arrays of propulsive outlets, fuels and pyrotechnics to produce the necessary forces for the desired two-dimensional course correction. However, these devices suffer from significant disadvantages, such as the danger of premature explosion, and the shock caused by these devices often leads to imprecise course corrections.

Part of such past projectiles have been guidance kits with steering mechanisms for steering the spinning or rolling projectiles. There is a need for improvement of such kits and steering mechanisms.

SUMMARY OF THE INVENTION

According to an aspect of the invention, a steering mechanism includes a rolling collar having ailerons that passively change angle of attack as a function of dynamic pressure.

According to another aspect of the invention, an air vehicle includes: a fuselage that rolls about a longitudinal axis of the fuselage; and a collar that is positionable relative to the fuselage. The collar includes ailerons that passively change angle of attack as a function of dynamic pressure of the projectile.

According to yet another aspect of the invention, an air vehicle includes: a fuselage that rolls about a longitudinal axis of the fuselage; and a collar that is positionable relative to the fuselage. The collar includes ailerons that provide a circumferential force on the collar during flight of the projectile. The ailerons resiliently change angle of attack as a function of dynamic pressure of the projectile.

According to still another aspect of the invention, a fuzewell guidance kit includes: a guidance kit fuselage; and a collar that is rotatable relative to the fuselage. The collar includes ailerons that passively change angle of attack as a function of dynamic pressure.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

A spinning, rolling, or roll-stabilized object or vehicle, such as a projectile, includes a fuselage that rotates about its longitudinal axis (spins) during flight. A collar is positionable relative to the fuselage to steer the projectile, with the collar having ailerons to provide a roll force to position the collar. The collar also has elevators to provide lateral force to steer the projectile. The positioning of the collar may be accomplished by moderating the roll force of the ailerons with a constraining force, such as a braking force, to hold the position of the collar substantially constant with regard to a longitudinal axis of the projectile. The ailerons passively change effective angle of attack with changes in the dynamic pressure of the projectile. At low speeds the passive ailerons have a relatively large angle of attack, in order to provide a sufficient roll force to counter-rotate the collar in the opposite direction from the spin (roll) direction of the projectile. At high speeds, when roll forces are easier to generate with the ailerons, the ailerons resiliently reduce their angles of attack, avoiding large rolling forces on the collar. By limiting the rolling forces on the collar, the amount of counter braking or other restraining force used in positioning the collar is limited. This allows more efficiency in use of energy during flight of the projectile. The passive change of aileron angle of attack may be accomplished through any of a variety of mechanism, such as torsion bars, leaf springs, or torsion springs.

Figure 1:
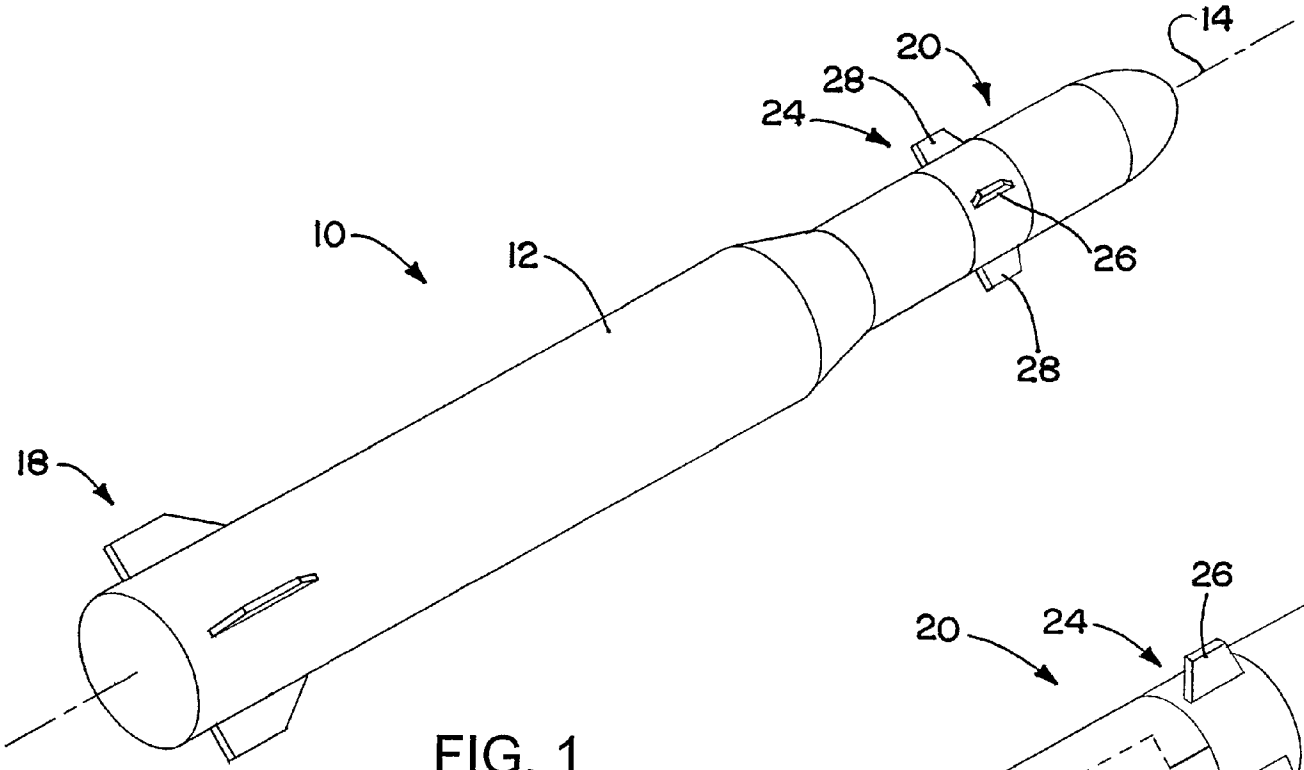
FIG. 1 is an oblique view of a projectile in accordance with an embodiment of the present invention.

FIG. 1 shows a vehicle or projectile 10 that has a spinning or rolling fuselage 12. The fuselage 12 rotates about a longitudinal axis 14 of the fuselage 12. The projectile 10 may be spun as part of a launching process, and/or may have a spin or roll moment imparted to it during flight, for example using moment-producing surfaces in the airstream, such as angled or otherwise lift-producing tail fins 18, canards, or wings, or by using thrust mechanisms.

In the illustrated embodiment, the projectile 10 also includes a fuzewell guidance kit 20 that is coupled to a front end of the fuselage 12. A "fuzewell guidance kit" is used herein to refer to a device that combines guidance and fuzing in one device that is installed in a fuze well. The guidance kit 20 fits into a fuze well for receiving a fuze, as part of a projectile 10. The guidance kit 20 may include a fuse for detonating a warhead or other explosive of the projectile 10 (not shown), perhaps when the projectile 10 is in proximity to a target.

Figure 2:
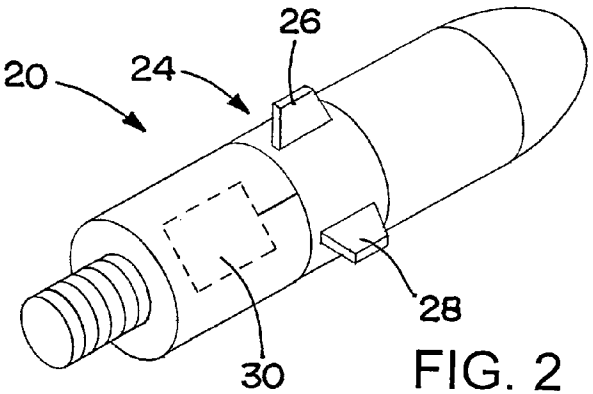
FIG. 2 is an oblique view of a guidance kit that is part of the projectile of FIG. 1.

The guidance kit 20 also performs a guidance function used in steering the spin-stabilized projectile 10. With reference in addition to FIG. 2, the guidance kit 20 includes a collar 24 that is rotatable relative to the spinning or rolling fuselage 12, as well as relative to a guidance kit fuselage 22 that rolls along with the fuselage 12. The collar 24 can be positioned relative to the fuselage 12 to position lift-producing aerodynamic surfaces (elevators) 26 to provide lateral forces to steer the projectile 10 using bank-to-turn steering. The collar 24 also includes ailerons 28 that provide a rotational (circumferential) force that is used to position the collar 24. The aerodynamic force from the ailerons 28 cause the collar 24 to rotate relative to the fuselage 12, for example causing the collar 24 to rotate in a direction opposite to that of the fuselage 12. This counter-rotation of the collar 24 may be modulated by use of a brake 30. This allows the collar 24 to be positioned so as to be maintained in a substantially-constant position relative to a coordinate system that moves with translation of the projectile 10, but does not rotate with spinning or rolling of the fuselage 12. Thus the collar 24 may be positioned relative to the longitudinal axis 14 to allow the lateral force from the elevators 24 to be applied in the right direction in order to achieve the desired bank-to-turn steering of the projectile 10.

The brake 30 may use any of a variety of suitable known mechanisms for slowing the relative rotation between the collar 24 and the fuselage 12. The brake 30 may utilize frictional forces, electrical forces (as in an electric motor), or magnetic forces to slow the relative rotation between the collar 24 and the fuselage 12. This allows positioning of the collar 24 to be obtained and maintained as desired.

With increasing dynamic pressure (speed) of the projectile 10, ailerons that have a fixed angle of attack provide increasing aerodynamic force to counter-rotate the collar 24 relative to the fuselage 12. An increase in the counter-rotation aerodynamic force would require use of more braking force to position the collar 24. This would require the brake 30 to be able to exert more force, and/or may require more energy to be expended in applying braking force to position the collar 24.

In order to reduce the amount of braking required at high projectile dynamic pressures, the ailerons 28 passively alter their angles of attack as a function of the dynamic pressure of the projectile 10. The alteration of angle of attack is passive in that there is no directed input force or commanded action that causes the change of angle of attack. The change of angle of attack is a result of the configuration of a mechanism that allows change of the aileron angle of attack, with aerodynamic forces being balanced against resilient forces. Some sort of resilient force balances against the aerodynamic forces on the ailerons 28 to put the ailerons 28 at different angles of attack for different levels of different aerodynamic force (different dynamic pressures of the projectile 10).

The vehicle is described herein in terms of a projectile that travels through air. However aileron positioning system may be used in a variety of air vehicles, whether powered missiles, unpowered projectiles, or other sorts of air vehicles.

The resilient force for positioning the ailerons 28 may be from any of a variety of mechanisms, such as leaf springs, torsion bars, torsion springs, and elastic bands. A few of these resilient mechanisms are shown in the illustrative embodiments described below.

Figure 3:
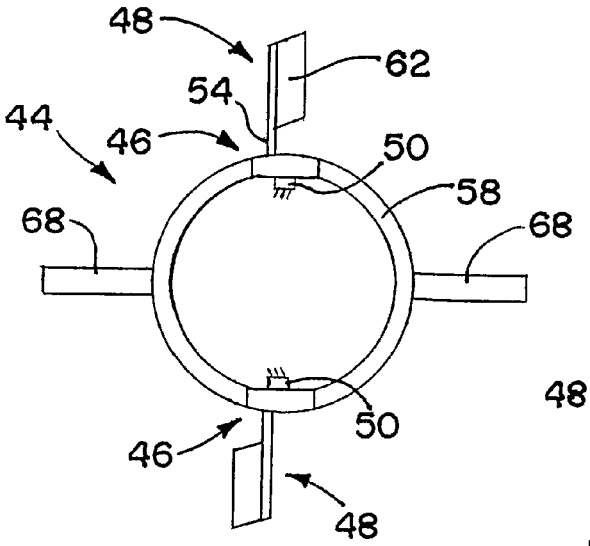
FIG. 3 is a cross-sectional view of a collar according to an embodiment of the invention.
Figure 4:
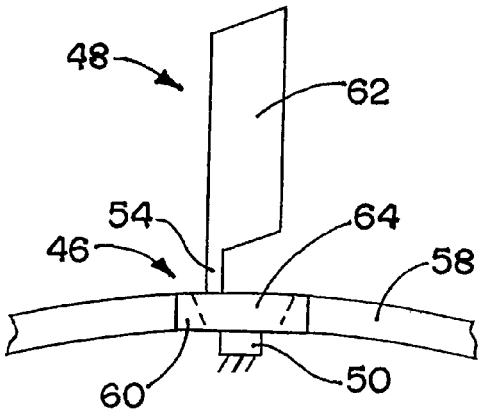
FIG. 4 is a detailed view of part of the collar of FIG. 3.
Figure 5:
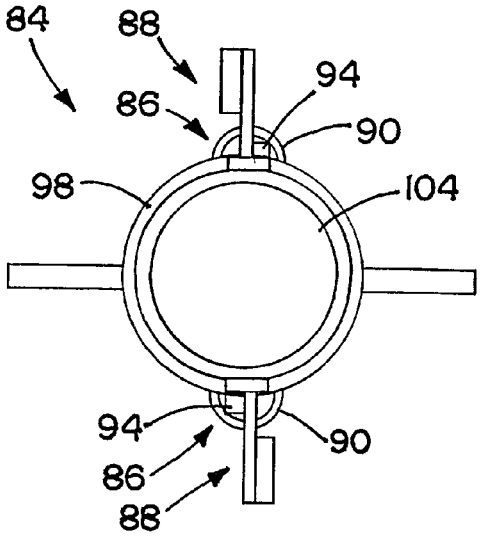
FIG. 5 is a cross-sectional view of a collar according to another embodiment of the invention.
Figure 6:
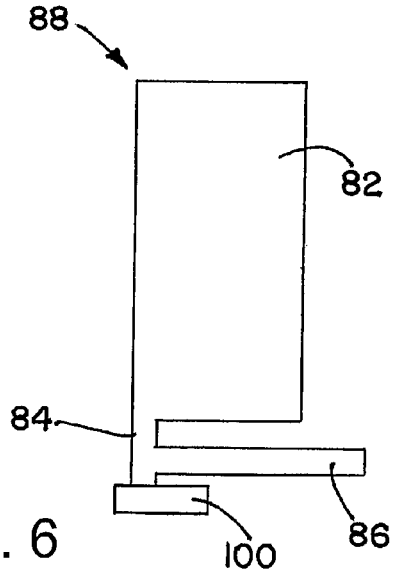
FIG. 6 is a detailed view of part of the collar of FIG. 5.

FIGS. 3 and 4 illustrate a collar 44 having a mechanism 46 that allows ailerons 48 to passively change angle of attack. The mechanism 46 includes, for each of the ailerons 48, a torsion bar 50 that is coupled at one end to a shaft 54 of the aileron 48, for example using corresponding keys on the end of the torsion bar 50 and the aileron 48. The opposite end of the torsion bar 50 is fixed relative to a collar housing 58, such as by use of a key (not shown) on the torsion bar 50 that fits into a corresponding keyed surface of the collar housing 50. The torsion bar 50 thus resiliently provides resistance for rotation of the shaft 54 relative to the collar housing 58. A bearing 60 is coupled to the shaft 54 and the collar housing 58 to provide support to the aileron 48 as the aileron 48 experiences aerodynamic forces on a blade 62 of the aileron 48 during projectile flight. The bearing 60 may be a journal bearing with a rounded shaft end 64 movable within the bearing 60 to allow the aileron 48, to shift position relative to the collar housing 58, for example shifting angle of attack, while still being able to transmit aerodynamic loads from the blade 62 to the collar housing 58.

The torsion bar 50 may be a piece of metal of any of a variety of shapes. The torsion bar 50 may be configured so that it is unloaded when there are no aerodynamic forces on the aileron 48, with the aileron 48 at a maximum angle of attack. Aerodynamic forces put a torque on the aileron 48, and the torsion bar 50 provides a resistance to the change of angle of attack of the aileron 48. The balance between the aerodynamic forces on the aileron blade 62 and the forces from the twisting of the torsion bar 50 establishes the aileron position (angle of attack) for any given dynamic pressure (speed). The ailerons 48 thus passively change angle of attack as a function of projectile dynamic pressure, reducing the angle of attack as the projectile dynamic pressure increases.

The collar 44 includes other parts that are not described further. For example the collar 44 (and the collars of the other embodiments described below) includes fixed-angle-of-attack elevators 68.

Figure 7:
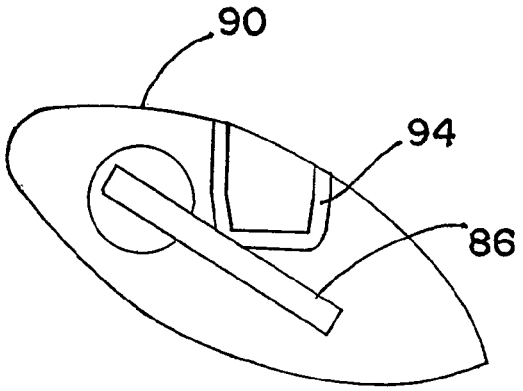
FIG. 7 is a plan view of an aileron of the collar of FIG. 5 in a first configuration.
Figure 8:
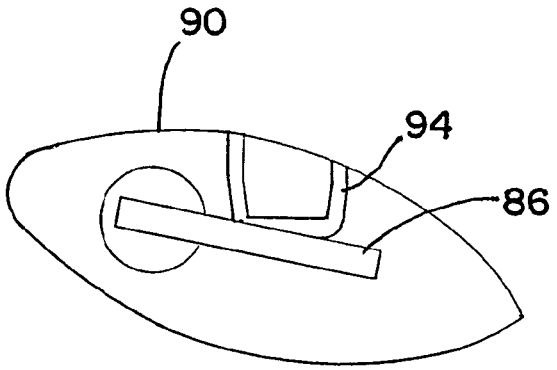
FIG. 8 is a plan view of the aileron of FIG. 7 in a second configuration.

FIGS. 5-8 show another embodiment, a collar 84 has a mechanism 86 for passively changing the angle of attack of ailerons 88. The mechanism 86 is located within blisters 90 on the outside of a collar housing 98. The ailerons 88 each have a blade 82 and a shaft 84, with a tab 86 extending from the shaft 84 within the blister 90. Also within each of the blisters 90 is a resilient device 94, such as a leaf spring, that is in contact with the tab 86. The spring 94 biases the aileron 88 to a certain low-speed angle of attack, for example 10 degrees (FIG. 7). The spring 94 also provides resistance to changes in angle of attack as the projectile increases its dynamic pressure, with the angle of attack decreasing with increasing dynamic pressure, for example to a high-speed angle of attack of 3 degrees (FIG. 8). A bearing 100 may be used to allow the aileron 88 to shift position (angle of attack), while still mechanically supporting the aileron 88. The bearing 100 may be a journal bearing that functions in a manner similar to that of the bearing 60 (FIG. 3).

The blisters 90 may have a streamlined shape that provides low drag. The use of the blisters 90 prevents the mechanism 86 from intruding into an interior space 104 surrounded by the collar 84. This allows for the same interior space configuration as for a projectile that does not have the passively-movable ailerons 88 such as described above.

Figure 9:
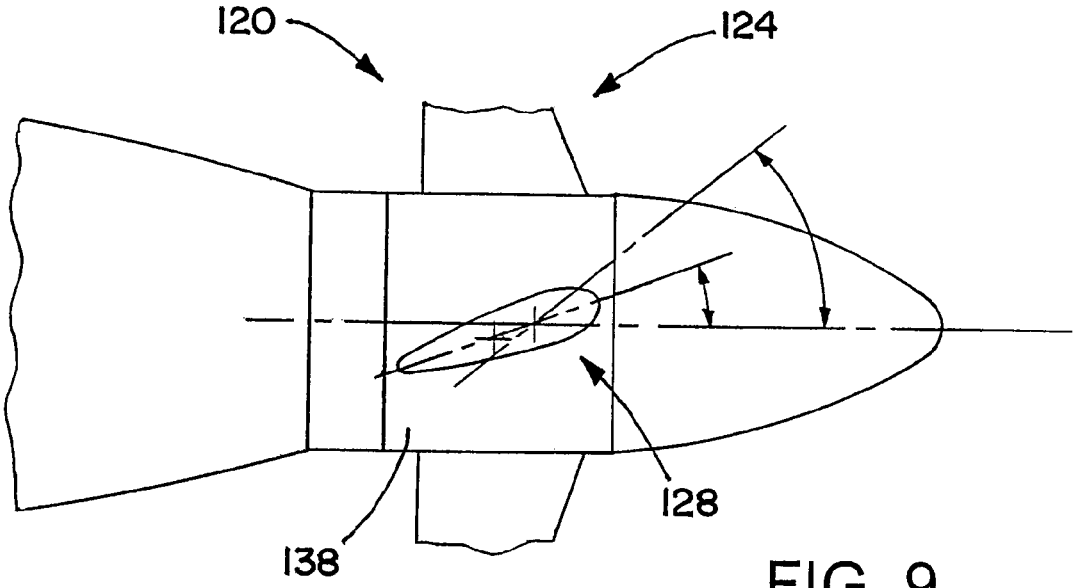
FIG. 9 is a side view of a fuzewell guidance kit in accordance with yet another embodiment of the invention.
Figure 10:
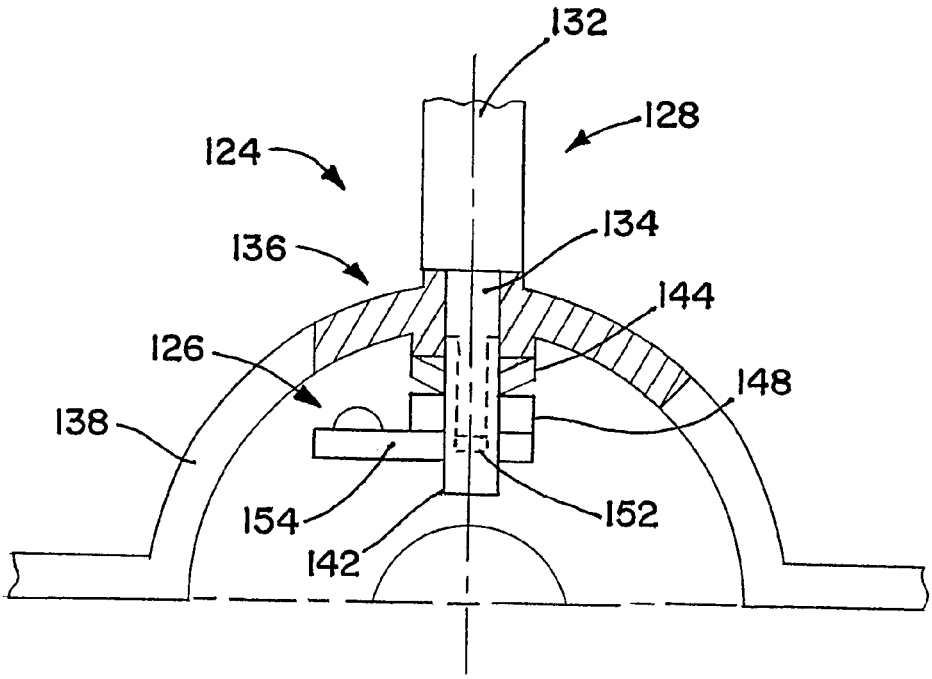
FIG. 10 is a cross-sectional view of a collar of the fuzewell guidance kit of FIG. 9.
Figure 11:
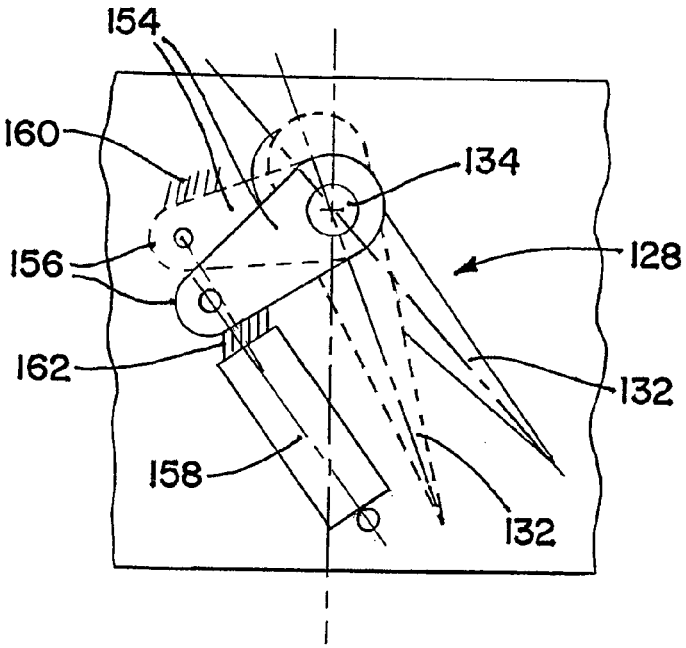
FIG. 11 is a view schematically showing the operation of the aileron adjustment mechanism of the guidance kit of FIG. 9.

FIGS. 9-11 shows a further embodiment, a fuzewell guidance kit 120 with a collar 124 that has a mechanism 126 to allow ailerons 128 to passively change angle of attack. The ailerons 128 each have a blade 132 that is attached to a shaft 134. The blade 132 and the shaft 134 may even be portions of a single continuous unitary part.

The shaft 134 passes through a hole 136 in a collar housing 138. The hole 136 may have a bearing around it to aid in allowing the aileron 128 to shift position (angle of attack). The shaft 134 has a threaded shaft end 142. A spring washer (Belleville washer) 144 is held onto the shaft end 142 by a nut 148 that is threaded onto the shaft end 142. The spring washer 144 is used to keep the aileron 128 pulled in against the collar housing 138.

A pin 152 is used to connect a crank 154 rigidly to the shaft end 142. A distal end 156 of the crank 154 is connected to a tension spring 158 that is used to bias the aileron to a maximum angle of attack, and to provide resistance against passive reduction of the angle of attack by aerodynamic forces on the aileron 128. The tension spring 158 may be any of a variety of suitable springs. Stops 160 and 162 may be provided to limit the travel of the crank 154, providing limits to the maximum and/or minimum angle(s) of attack obtainable by the ailerons 128. FIG. 11 shows the two extreme positions of the crank 154, against the stops 160 and 162.

Figure 12:
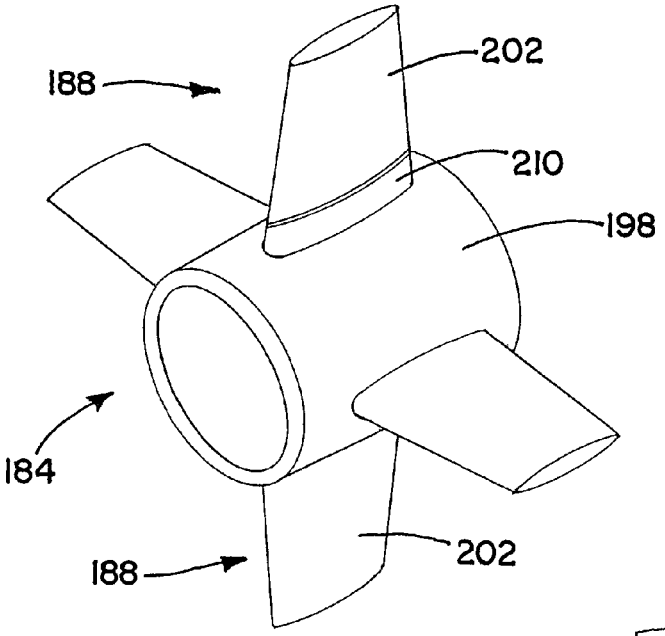
FIG. 12 is an oblique view of a collar in accordance with still another embodiment of the present invention.
Figure 13:
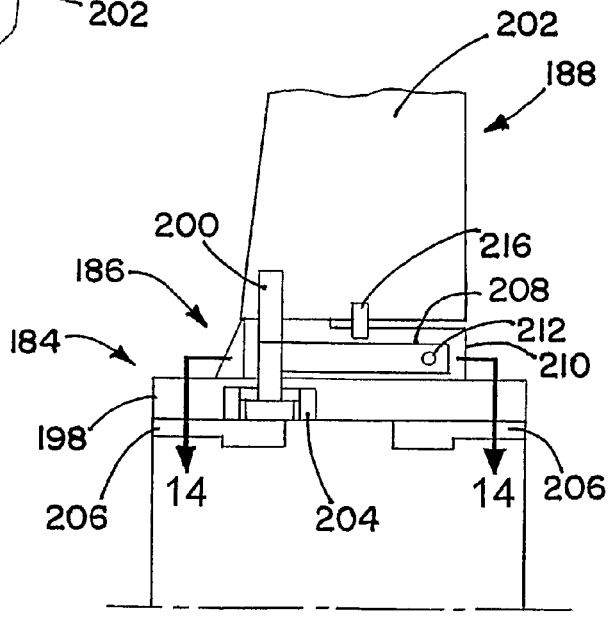
FIG. 13 is a side cross-sectional view of a portion of the collar of FIG. 12.
Figure 14:
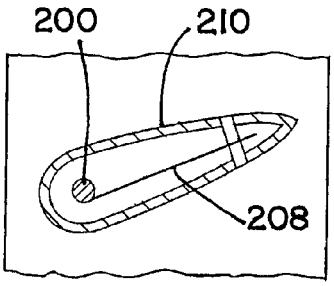
FIG. 14 is a view along section 14-14 of FIG. 13.

FIGS. 12-14 show still another embodiment, a collar 184 in which a mechanism 186 is used to allow ailerons 188 to passively change their angles of attack. Each aileron 188 is coupled to a collar housing 198 by use of a pivot pin 200 that threads into an aileron blade 202, and passes through a hole in the collar housing 198. A bearing 204, retained by a bearing retainer 206, is used to allow the pivot pin 200, and thus the aileron 188, to swivel relative to the collar housing 198. An elastic band 208, located in an outward protrusion 210 from the collar housing 198, is attached at one end to the pivot pin 200, and at an opposite end to a second pin 212 that extends between opposite walls of the protrusion 210. The elastic band 208 wraps around the pivot pin 200. Stretching of the elastic band 208 provides resistance to reductions in angle of attack from an initial maximum value that occurs when the projectile is not moving. The balance between the aerodynamic forces on the blade 202, and the restorative elastic force from the stretched elastic band 208, positions the ailerons 188, with the ailerons 188 passively reducing their angles of attack as the dynamic pressure of the projectile increases. One or more travel limit pins 216 may be used as mechanical stops to limit the angle of attack of the ailerons 188.

In the foregoing embodiments the ailerons are able to change angle of attack independently of one another. This may improve performance at high angles of attack, by allowing each aileron to relax to the local angle of attack determined by the restoring force. For fixed projectiles collar spin reversal may be possible for some combinations of dynamic pressure and high projectile angle of attack. Slightly different angles of attack for the different ailerons may aid in avoiding this collar spin reversal. As an alternative, however, the angles of attack of the two ailerons may be linked, for example by mechanically linking the ailerons.

By varying the aileron incidence angle inversely with dynamic pressure, single collar configuration can accommodate a large combination of projectiles, projectile charges, and gun elevation angles. Other advantages for the collars described above are that their configurations are mechanically simple and self adjusting, they provide only a minimal increase in collar inertia, and they are inexpensive, gun hardenable, and do not require external power or sensors.

Many of the features described above with regard to one or more of the embodiments may be combined with features of the other embodiments. Examples of features that may be used with other embodiments include use of blisters, mechanical stops, pivot bearings or other bearings, having aileron adjustment mechanisms located in whole or in part within a collar housing, alternating adjustable ailerons with elevators around the perimeter of a collar housing, inclusion of elevators for bank-to-turn steering, and the collars being parts of a fuzewell guidance kit.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle comprising:

a fuselage that rolls about a longitudinal axis of the fuselage; and a collar that is positionable relative to the fuselage;

wherein the collar includes ailerons that passively change angle of attack without a directed input force or commanded action, relative to a collar housing of the collar, as a function of dynamic pressure of the projectile, with the change in angle of attack involving aerodynamic forces on the ailerons being balanced against resilient forces on the ailerons; and wherein the resilient forces are provided by resilient devices that are operatively coupled to the ailerons, in opposition to a pressure force on the ailerons that tends to reduce the angle of attack of the ailerons by pivoting the ailerons as the dynamic pressure increases.

2. The air vehicle of claim 1, wherein the ailerons provide a circumferential force on the collar during flight of the projectile to counter-roll the collar in an opposite direction from the fuselage.

3. The air vehicle of claim 1, wherein the resilient devices include torsion bars that are operatively coupled to the ailerons to position the ailerons.

4. The air vehicle of claim 1, further comprising blisters external to a collar housing of the collar, wherein at least part of the resilient devices for changing angle of attack of the ailerons is located in the blisters.

5. The air vehicle of claim 1, wherein the collar also includes elevators;

wherein the ailerons are used for positioning the collar relative to the fuselage; and wherein the elevators are used to provide a steering force on the projectile.

6. The air vehicle of claim 5, wherein the elevators each have a fixed angle of attack.

7. The air vehicle of claim 5, wherein the elevators are used for bank-to-turn steering.

8. The air vehicle of claim 1, further comprising mechanical stops that limit angle of attack changes of the ailerons.

9. The air vehicle of claim 1, wherein the ailerons passively change angle of attack independently of one another.

10. The air vehicle of claim 1, further comprising a brake to brake counter-rolling of the collar relative to the fuselage.

11. The air vehicle of claim 1, wherein collar is part of a fuzewell guidance kit.

12. An air vehicle comprising:

a fuselage that rolls about a longitudinal axis of the fuselage; and a collar that is positionable relative to the fuselage;

wherein the collar includes ailerons that passively change angle of attack without a directed input force or commanded action as a function of dynamic pressure of the projectile; and wherein the ailerons resiliently change angle of attack as a function of the dynamic pressure of the projectile; and further comprising respective springs operatively coupled to the ailerons that provide a spring force, in opposition to a pressure force on the ailerons that tends to reduce the angle of attack of the ailerons by pivoting the ailerons as the dynamic pressure increases.

13. The air vehicle of claim 12, wherein the spring force is provided by leaf springs.

14. The air vehicle of claim 12, wherein the spring force is provided by torsion springs.

15. The air vehicle of claim 12, wherein the spring force is provided by elastic bands.

16. An air vehicle comprising:

a fuselage that rolls about a longitudinal axis of the fuselage; and a collar that is positionable relative to the fuselage;

wherein the collar includes ailerons that provide a circumferential force on the collar during flight of the projectile; and wherein the ailerons resiliently change angle of attack without a directed input force or commanded action, relative to a collar housing of the collar, as a function of dynamic pressure of the projectile, with the change in angle of attack involving aerodynamic forces on the ailerons being balanced against resilient forces on the ailerons; and wherein the resilient forces are provided by resilient devices that are operatively coupled to the ailerons, in opposition to a pressure force on the ailerons that tends to reduce the angle of attack of the ailerons by pivoting the ailerons as the dynamic pressure increases.

17. A fuzewell guidance kit comprising:

a guidance kit fuselage;

a collar that is rotatable relative to the fuselage;

wherein the collar includes ailerons that passively change angle of attack without a directed input force or commanded action, relative to a collar housing of the collar, as a function of dynamic pressure, with the change in angle of attack involving aerodynamic forces on the ailerons being balanced against resilient forces on the ailerons; and wherein the resilient forces are provided by resilient devices that are operatively coupled to the ailerons, in opposition to a pressure force on the ailerons that tends to reduce the angle of attack of the ailerons by pivoting the ailerons as the dynamic pressure increases.

18. The guidance kit of claim 17, wherein the collar also includes a pair of fixed-angle-of-attack elevators.

* * * * *